US009664007B2

(12) United States Patent
Lopez et al.

(10) Patent No.: US 9,664,007 B2
(45) Date of Patent: May 30, 2017

(54) ELECTRIC CONTROL MULTI-POSITION ICD

(71) Applicant: HALLIBURTON ENERGY SERVICES, INC., Houston, TX (US)

(72) Inventors: Jean Marc Lopez, Plano, TX (US); Luke William Holderman, Richardson, TX (US); Michael L. Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 407 days.

(21) Appl. No.: 14/234,389

(22) PCT Filed: Feb. 8, 2013

(86) PCT No.: PCT/US2013/025419
§ 371 (c)(1),
(2) Date: Jan. 22, 2014

(87) PCT Pub. No.: WO2014/123539
PCT Pub. Date: Aug. 14, 2014

(65) Prior Publication Data
US 2014/0338922 A1 Nov. 20, 2014

(51) Int. Cl.
*E21B 34/06* (2006.01)
*E21B 43/12* (2006.01)

(52) U.S. Cl.
CPC ..... *E21B 34/066* (2013.01); *E21B 43/12* (2013.01)

(58) Field of Classification Search
CPC ... E21B 34/066; E21B 43/12; E21B 2034/007
(Continued)

(56) References Cited

U.S. PATENT DOCUMENTS 5,803,167 A 9/1998 Bussear et al.
6,311,772 B1 11/2001 Myhre et al.
(Continued)

FOREIGN PATENT DOCUMENTS

WO 99/57417 A2 11/1999
WO 9957419 A2 11/1999
WO 2010025150 A2 3/2010

OTHER PUBLICATIONS

International Preliminary Report on Patentability issued in related PCT Application No. PCT/US2013/025419, mailed Aug. 20, 2015 (10 pages).
(Continued)

*Primary Examiner* — Michael Wills, III
(74) *Attorney, Agent, or Firm* — Scott Richardson; Baker Botts L.L.P.

(57) ABSTRACT

A production sleeve assembly for use in a wellbore comprises a wellbore tubular, a plurality of fluid pathways configured to provide fluid communication within the downhole component, a plurality of electronic actuators configured to selectively provide fluid communication through one or more of the plurality of fluid pathways, and at least one sensor coupled to the plurality of electronic actuators. One or more of the plurality of electronic actuators are configured to selectively actuate to allow or prevent fluid flow through a corresponding fluid pathway of the plurality of fluid pathways in response to the at least one sensor receiving a suitable signal.

10 Claims, 10 Drawing Sheets

(58) Field of Classification Search
USPC ..... 166/66.6
See application file for complete search history.

(56) References Cited

U.S. PATENT DOCUMENTS

| | | | | |
|---|---|---|---|---|
| 6,817,416 | B2 | 11/2004 | Wilson et al. | |
| 7,819,194 | B2 * | 10/2010 | Tips | E21B 21/103 166/316 |
| 8,684,087 | B1 * | 4/2014 | Lopez | E21B 34/063 166/317 |
| 2002/0043369 | A1 | 4/2002 | Vinegar et al. | |
| 2002/0157837 | A1 | 10/2002 | Bode et al. | |
| 2006/0175052 | A1 | 8/2006 | Tips | |
| 2007/0056745 | A1 | 3/2007 | Contant | |
| 2008/0283238 | A1 | 11/2008 | Richards et al. | |
| 2009/0101329 | A1 | 4/2009 | Clem et al. | |
| 2009/0101341 | A1 | 4/2009 | Willauer | |
| 2009/0277650 | A1 | 11/2009 | Casciaro et al. | |
| 2010/0175867 | A1 * | 7/2010 | Wright | E21B 41/00 166/57 |
| 2013/0000922 | A1 | 1/2013 | Skinner et al. | |
| 2013/0020088 | A1 | 1/2013 | Dyer et al. | |
| 2013/0048290 | A1 * | 2/2013 | Howell | E21B 34/08 166/305.1 |
| 2013/0186639 | A1 * | 7/2013 | Zhao | E21B 34/08 166/373 |
| 2013/0284451 | A1 * | 10/2013 | Merron | E21B 43/26 166/373 |
| 2014/0083689 | A1 * | 3/2014 | Streich | E21B 34/063 166/250.15 |
| 2014/0202706 | A1 * | 7/2014 | Howell | E21B 34/102 166/374 |
| 2015/0027706 | A1 * | 1/2015 | Symms | E21B 34/066 166/289 |
| 2015/0027724 | A1 * | 1/2015 | Symms | E21B 34/16 166/373 |
| 2015/0233205 | A1 * | 8/2015 | Wang | E21B 21/003 166/250.01 |

OTHER PUBLICATIONS

Foreign Communication from a Related Counterpart Application, International Search Report and Written Opinion dated Nov. 5, 2013, International Application Serial No. PCT/US13/25419, filed on Feb. 8, 2013.

Search Report issued in related European Application No. 13874385.1, mailed Jun. 29, 2016 (7 pages).

Official Action issued in related Singapore application No. 11201505258S, mailed on Apr. 11, 2016 (10 pages).

Office Action issued in the related Singapore Application No. 11201505258S, mailed Nov. 17, 2016 (6 pages).

* cited by examiner

ELECTRIC CONTROL MULTI-POSITION ICD

CROSS-REFERENCE TO RELATED APPLICATIONS

This application is a filing under 35 U.S.C. 371 as the National Stage of International Application No. PCT/US2013/025419, filed Feb. 8, 2013, entitled "Electric Control Multi-Position ICD", by Jean Marc Lopez, et al., which is incorporated herein by reference in its entirety for all purposes.

BACKGROUND

Wellbores are sometimes drilled into subterranean formations to produce one or more fluids from the subterranean formation. For example, a wellbore may be used to produce one or more hydrocarbons. Where fluids are produced from a long interval of a formation penetrated by a wellbore, it is known that balancing the production of fluid along the interval can lead to reduced water and gas coning, and more controlled conformance, thereby increasing the proportion and overall quantity of oil or other desired fluid produced from the interval. Various devices and completion assemblies have been used to help balance the production of fluid from an interval in the wellbore. For example, various flow devices have been used in conjunction with well screens to restrict the flow of produced fluid through the screens for the purpose of balancing production along an interval.

SUMMARY

In an embodiment, a production sleeve assembly for use in a wellbore comprises a wellbore tubular, a plurality of fluid pathways configured to provide fluid communication within the downhole component, a plurality of electronic actuators configured to selectively provide fluid communication through one or more of the plurality of fluid pathways, and at least one sensor coupled to the plurality of electronic actuators. One or more of the plurality of electronic actuators are configured to selectively actuate to allow or prevent fluid flow through a corresponding fluid pathway of the plurality of fluid pathways in response to the at least one sensor receiving a suitable signal.

In an embodiment, a production sleeve assembly for use in a wellbore comprises a wellbore tubular, a plurality of fluid pathways configured to provide fluid communication between an exterior of the wellbore tubular and the interior of the wellbore tubular, a plurality of electronic actuators, and at least one sensor coupled to the plurality of electronic actuators. At least one of the plurality of electronic actuators comprises a rupture devices disposed adjacent an actuable devices, and the plurality of electronic actuators is configured to selectively provide fluid communication through one or more of the plurality of fluid pathways. The rupture device is configured to actuate the actuable device to allow fluid flow through at least one fluid pathway of the plurality of fluid pathways in response to the at least one sensor receiving a suitable signal.

In an embodiment, a method of configuring a production sleeve assembly within a wellbore comprises receiving a signal at a sensor, determining that the signal is a suitable signal, receiving, by one or more electronic actuators of a plurality of electronic actuators, power from a power source, actuating the one or more electronic actuators in response to the determination that the signal is the suitable signal, and selectively opening one or more fluid pathways of a plurality of fluid pathways in response to the actuating of the electronic actuator.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
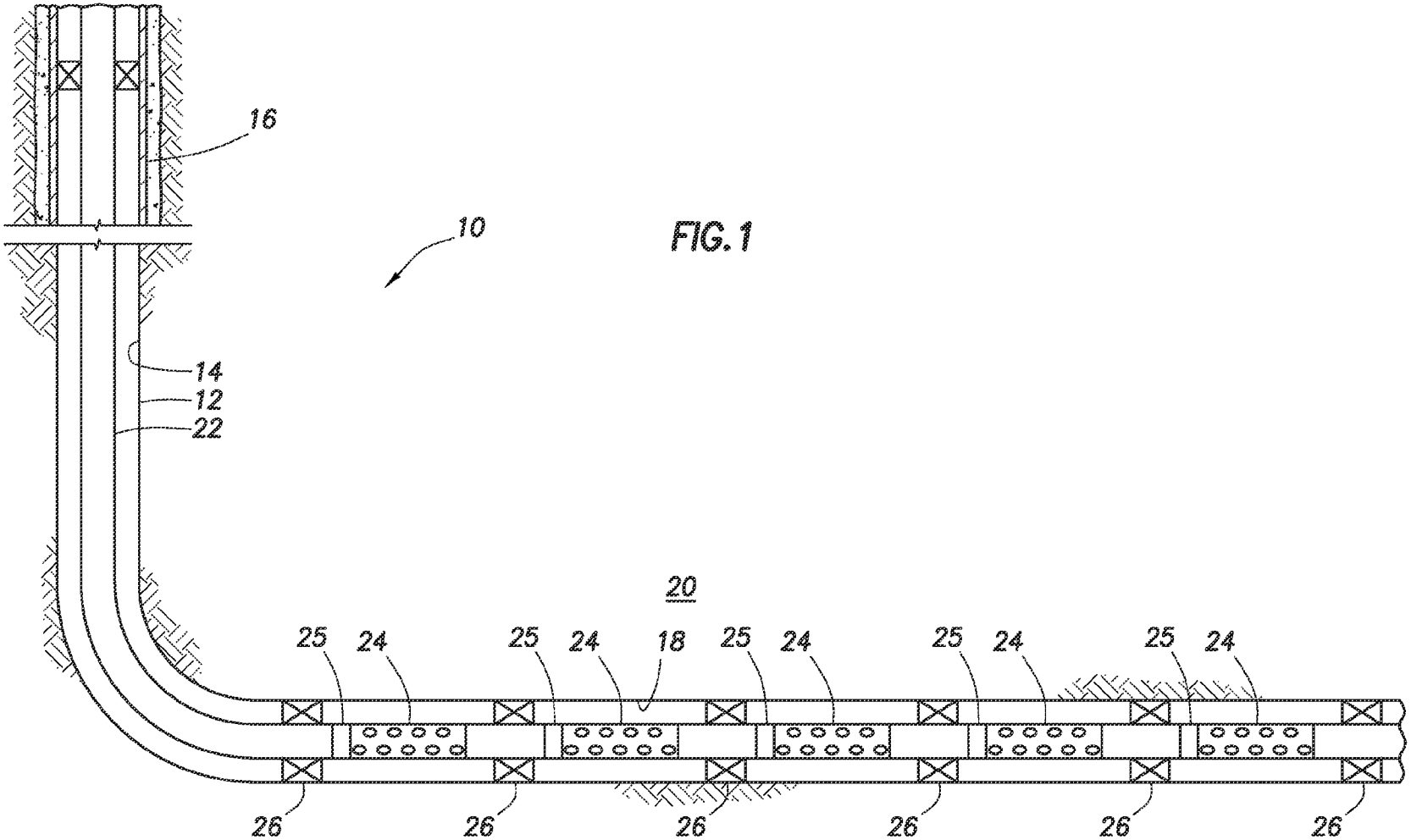
FIG. 1 is a schematic illustration of a wellbore operating environment according to an embodiment.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper," "upward," "up-hole," or other like terms shall be construed as generally from the formation toward the surface or toward the surface of a body of water; likewise, use of "down," "lower," "downward," "down-hole," or other like terms shall be construed as generally into the formation away from the surface or away from the surface of a body of water, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

Well systems may be used to provide a completion configuration including one or more flow restrictions intended to balance production along a section of a wellbore. A flow restriction may form a part of a well screen assembly and thereby provide a desired resistance to fluid flow between the screen assembly chamber and the wellbore tubular interior. In order to provide flexibility in selecting the resistance to flow, multiple flow restrictions can be disposed in parallel and/or series through a fluid pathway such as a flow chamber and/or one or more ports with flow restrictions. The well screen assembly can also include a bypass port or pathway in parallel with the flow restriction(s) such that opening the bypass may provide a relatively unrestricted flow path between the exterior of the well screen assembly and the wellbore tubular interior. Such a well screen assembly may comprise a fluid pathway in series with the flow restriction and the wellbore tubular interior, and fluid may flow from the screen assembly to the wellbore tubular interior via the fluid pathway.

During installation, a blocking member or means can be disposed proximate the fluid pathway to prevent fluid flow between the formation and the wellbore tubular interior. After installation, when fluid flow into the wellbore tubular interior is desired, an actuation member or means may act upon the blocking member to allow fluid flow through the fluid pathway. As operators increasingly pursue more complicated completions in deep water offshore wells, highly deviated wells and extended reach wells, the use of tradition sources of actuation such as pressurized fluid has become more difficult. Disclosed herein is a downhole actuation system operable to selectively provide fluid flow through a fluid pathway that does not require actuation by way of delivering pressurized fluid to rupture a barrier. The downhole actuation system can be used in complicated completions in deep water offshore wells, highly deviated wells and extended reach wells. As disclosed herein, the downhole actuation system comprises an electronic actuator assembly that comprises electronic means for selectively providing and/or preventing fluid flow from the formation into the wellbore tubular interior.

The electronic actuator assembly may be incorporated in a production sleeve assembly for use in a wellbore, which may control fluid communication between the exterior of the wellbore tubular and the wellbore tubular interior. The production sleeve assembly may comprise a chamber in fluid communication with the exterior of the wellbore tubular, a flow control device, and a fluid pathway providing fluid communication between the chamber and the wellbore tubular interior. The combined fluid communication pathway between the exterior of the wellbore tubular and the wellbore tubular interior may be referred to as a fluid pathway. An electronic actuator may be provided to control fluid flow through the fluid pathway. For example, the production sleeve assembly can be installed within the well with the electronic actuator assembly in its unactuated configuration. In this configuration, fluid may be substantially prevented from flowing through the fluid pathway. Once the production sleeve is installed, the electronic actuator can be actuated to allow fluid flow through the fluid pathway and thus provide fluid communication from the exterior of the wellbore tubular to the wellbore tubular interior. In some embodiments, the electronic actuator can be re-actuated to a third state and/or return to the initial configuration and thereby prevent fluid communication between the exterior of the wellbore tubular to the wellbore tubular interior. The ability to reset the electronic actuator may provide increased flexibility in selecting the flow state and/or the resistance to flow through the production sleeve assembly.

In an embodiment, the electronic actuator assembly may comprise a blocking member or means and a retracting member or means connected to an actuator such as an electro-mechanical actuator (e.g., a motor, solenoid, pressure generator and piston assembly, etc.) for moving the blocking member between an unactuated configuration and an actuated configuration. Actuation can occur by activating the electro-mechanical actuator to cause the retracting member to move and thereby reposition the blocking member out of the fluid pathway. The electro-mechanical actuator may be connected to a power source and a sensor, such that the electro-mechanical actuator becomes electrically activated in response to the sensor detecting a signal. Various configurations of the retracting member are possible. In some embodiments, the retracting member is a piston that slides the blocking member at least partially out of the fluid pathway. In other embodiments, the retracting member is a geared mechanism, which translates the blocking member at least partially out of the fluid pathway, for example, to uncover a port or fluid passage. In another embodiment, the electronic actuator comprises an electronic burst disk. For example, in an unactuated position, a disk may be positioned proximate the fluid pathway to prevent fluid flow therethrough. Upon actuation, a rupture device may create an opening (e.g., an orifice) through the disk, thereby allowing fluid flow through the opening. The rupture device can be connected to a power source and a sensor, such that the rupture device becomes electrically activated to create the opening in the disk in response to the sensor detecting a signal. In another embodiment, the electronic actuator may comprise an electrically triggered thermal expansion. The resulting thermal expansion may result from an exothermic chemical reaction and can be used to translate a sleeve or other moveable member. For example, a thermite reaction can be used to generate heat and a gas, thereby providing a pressurized fluid capable of causing a sleeve or piston to translate or shift.

Thus, the disclosed embodiments enable a user to selectively control the fluid flow through the fluid pathway by directing signal transmissions to the sensor. Moreover, some embodiments comprise simple components that remain dependable, even when installed in deep, highly deviated wells. Various configurations of the sensor are possible. In some embodiments, the sensor is a fluid sensor that can sense at least one particular physical property of a fluid, such as fluid pressure, flow, composition, etc. In some embodiments, the sensor is a fluid pressure sensor, which can be programmed to activate the electronic actuator in response to detecting a predetermined pressure. In some embodiments, the fluid pressure sensor can be programmed to respond to a first predetermined pressure by activating the electronic actuator to move the blocking member a first distance such that the blocking member partially covers the fluid pathway and/or a uncovers a first fluid port, and respond to a second predetermined pressure by activating the electronic actuator to move the blocking member a second distance such that the blocking member is substantially removed from the fluid pathway and/or uncovers a second fluid port, thereby providing means for selectively dimensioning the flow path. In some embodiments, the sensor is configured to detect particular pressure fluctuation patterns and, in response, activate the electronic actuator accordingly.

In some embodiments, the sensor is an electric sensor. For example, in some embodiments, the sensor is an electromagnetic telemeter that can detect particular electrical telemetric signals and respond by activating the electro-mechanical actuator accordingly. In some embodiments, the sensor is a wireless sensor, and the signal comprises a wireless electromagnetic signal. In other embodiments, the sensor is electrically coupled to the signal source, and the signal travels from the source to the sensor via the electric coupling.

The electronic actuator assembly can be incorporated into a production sleeve in series with a flow restriction. Multiple electronic actuators can be incorporated into a production sleeve, thereby allowing the user to selectively adjust flow into the wellbore tubular through the production sleeve by actuating various actuators. Thus, the electronic actuator assemblies disclosed herein provides selective adjustment of fluid flow into the wellbore, through the employment of simple and reliable components.

FIG. 1 is a schematic illustration of a well system, indicated generally 10, including a plurality of autonomous inflow control devices embodying principles of the present invention. A wellbore 12 extends through various earth strata. The wellbore 12 has a substantially vertical section 14, the upper portion of which has installed therein a casing string 16. The wellbore 12 also has a substantially horizontal section 18, which extends through a hydrocarbon bearing subterranean formation 20. As illustrated, the substantially horizontal section 18 of the wellbore is open hole. While shown as an open hole, the horizontal section of the wellbore, the invention will work in any orientation, and in open or cased hole.

Positioned within wellbore 12 and extending from the surface is a tubing string 22. Tubing string 22 provides a conduit for fluids to travel from formation 20 upstream to the surface. Positioned within tubing string 22 in the various production intervals adjacent to formation 20 are a plurality of autonomous flow control systems 25 and a plurality of production tubing sections 24. At either end of each production tubing section 24 is a packer 26 that provides a fluid seal between tubing string 22 and the wall of the wellbore 12. The space in-between each pair of adjacent packers 26 defines a production interval.

Each of the production tubing sections 24 may optionally include sand control capability. Sand control screen elements or filter media associated with production tubing sections 24 are designed to allow fluids to flow therethrough but prevent particulate matter of sufficient size from flowing therethrough. In an embodiment, the filter media is of the type known as "wire-wrapped," since it is made up of a wire closely wrapped helically about a wellbore tubular, with a spacing between the wire wraps being chosen to allow fluid flow through the filter media while keeping particulates that are greater than a selected size from passing between the wire wraps. It should be understood that the generic term "filter media" as used herein is intended to include and cover all types of similar structures which are commonly used in gravel pack well completions which permit the flow of fluids through the filter or screen while limiting and/or blocking the flow of particulates (e.g. other commercially-available screens, slotted or perforated liners or pipes; sintered-metal screens; sintered-sized, mesh screens; screened pipes; prepacked screens and/or liners; or combinations thereof). Also, a protective outer shroud having a plurality of perforations therethrough may be positioned around the exterior of any such filter medium.

Through use of the flow control system 25 of the present invention in one or more production intervals, some control over the volume and composition of the produced fluids is enabled. For example, in an oil production operation, if an undesired fluid component, such as water, steam, carbon dioxide, or natural gas, is entering one of the production intervals, the flow control system in that interval will autonomously restrict or resist production of the undesired fluid from that interval. It will be appreciated that whether a fluid is a desired or an undesired fluid depends on the purpose of the production or injection operation being conducted. For example, if it is desired to produce oil from a well, but not to produce water or gas, then oil is a desired fluid and water and gas are undesired fluids.

The fluid flowing into the production tubing section 24 typically comprises more than one fluid component. Typical components are natural gas, oil, water, steam, or carbon dioxide. The proportion of these components in the fluid flowing into each production tubing section 24 will vary over time and based on conditions within the formation 20 and wellbore 12. Likewise, the composition of the fluid flowing into the various production tubing sections throughout the length of the entire production string can vary significantly from section to section. The flow control system is designed to reduce or restrict from any particular interval the production of undesired fluids. Accordingly, a greater proportion of desired fluid component (e.g., oil) will be produced into the wellbore interior.

Although FIG. 1 depicts one flow control system in each production interval, it should be understood that any number of systems of the present invention can be deployed within a production interval without departing from the principles of the present invention. Likewise, the inventive flow control systems do not have to be associated with every production interval. They may only be present in some of the production intervals of the wellbore or may be in the wellbore interior to address multiple production intervals.

Figure 2A:
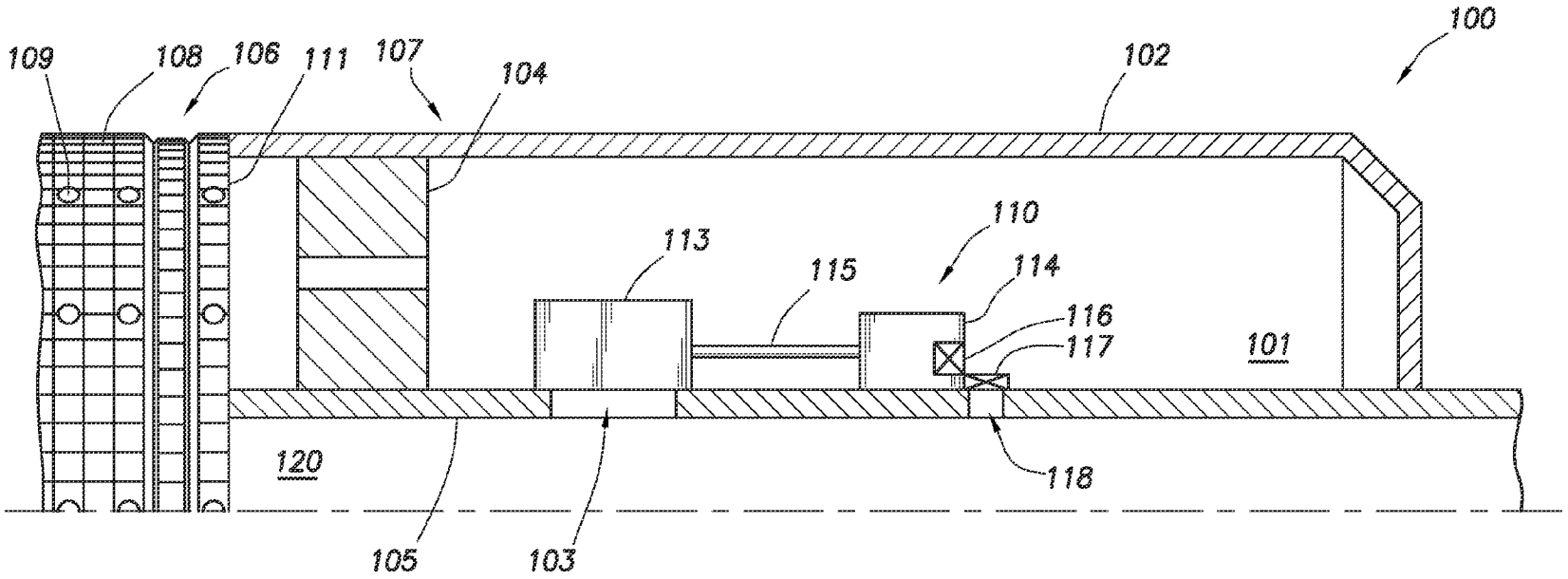
FIGS. 2A-2B are partial cross-sectional views of a well screen assembly comprising an embodiment of an electronic actuator.
Figure 2B:
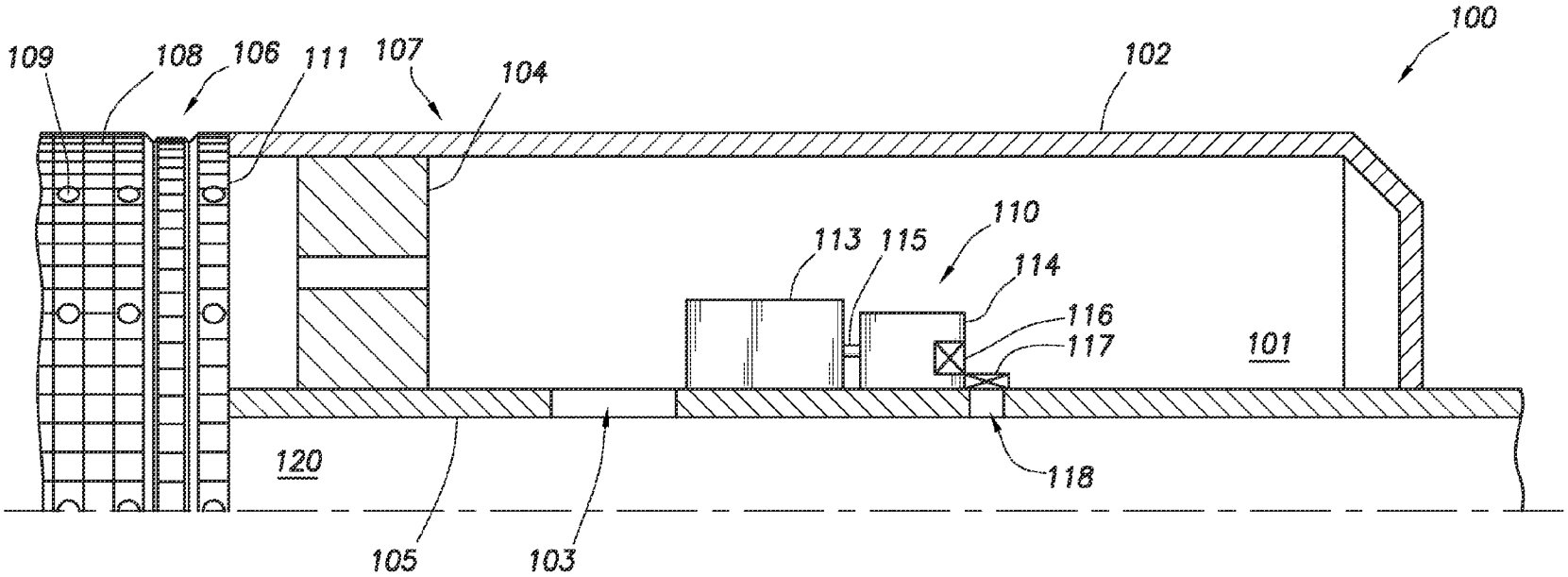

Referring next to FIGS. 2A and 2B, therein is depicted a production sleeve assembly comprising a chamber in fluid communication with the exterior of the wellbore tubular (e.g., formation 20), a flow control device 100, an electronic actuator assembly 110, and a fluid pathway 101 providing fluid communication between the chamber and the wellbore tubular interior 120 via a fluid pathway 103. The production sleeve assembly may comprise an outer housing 102 disposed about a wellbore tubular 105, thereby forming an annulus between the outer housing 102 and the wellbore tubular 105. The components of the production sleeve assembly may be disposed within the annulus, and the fluid pathway 101 may extend through the annulus while providing fluid communication between the exterior of the production sleeve assembly and the wellbore tubular interior 120.

In an embodiment, the fluid flow control device 100 may be integrated with an electronic actuator assembly 110 according to the present invention. The production sleeve assembly may be suitably coupled to other similar fluid flow control devices, seal assemblies, wellbore tubulars, and/or other downhole tools to form a tubing string as described above. The fluid flow control device 100 may comprise a sand control screen section 106 and a flow restriction section 107. The sand control screen section 106 may comprise an optional, suitable sand control screen element or filter medium, such as a wire wrap screen, a woven wire mesh screen or the like, designed to allow fluids to flow therethrough but prevent particulate matter of sufficient size from flowing therethrough. It will be appreciated that any suitable filter element may be used with the production sleeve assembly described herein. In the illustrated embodiments, a protective outer shroud 108 having a plurality of perforations 109 can be positioned around the exterior of the filter medium and serve to protect the filter media, if present, from damage during conveyance of the production sleeve assembly within the wellbore. The flow restriction section 107 may be fluidly coupled to the sand control screen section via an access port 111.

The flow restriction section 107 may comprise one or more flow restrictions 104 generally disposed within the fluid pathway 101, and each of the flow restrictions 104 may be configured to provide a specific resistance to the flow of fluid through the flow restriction 104. The combined resistance to the flow of a fluid through the production sleeve assembly may then be determined by the combined effect of the one or more flow restrictions open for flow through the production sleeve assembly. The flow restriction 104 may be selected to provide a resistance for balancing the production along an interval. Various types of flow restrictions can be used with the flow control device described herein. In the embodiment shown in FIG. 2, the flow restriction 104 comprises a nozzle that comprises a central opening 118 (e.g., an orifice) configured to cause a specified resistance and pressure drop in a fluid flowing through the flow restriction 104. The central opening 118 may have a variety of configurations from a rounded cross-section, to a cross-section in which one or more of the first edge or the second edge comprises a sharp-squared edge. In general, the use of a squared edge at either the first edge and/or the second edge and/or a non-circular cross section may result in a greater pressure drop through the orifice than other shapes. Further, the use of a squared edge may result in a pressure drop through the flow restriction that depends on the viscosity of the fluid passing through the flow restriction. The use of a squared edge may result in a greater pressure drop through the flow restriction for an aqueous fluid than a hydrocarbon fluid, thereby presenting a greater resistance to flow for any water being produced relative to any hydrocarbons (e.g., oil or gas) being produced. Thus, the use of a central opening comprising a squared edge may advantageously resist the flow of water as compared to the flow of hydrocarbons. In some embodiments described herein, a plurality of nozzle type flow restrictions may be used in series.

Each flow restriction 104 may also comprise one or more restrictor tubes. The restrictor tubes generally comprise tubular sections with a plurality of internal restrictions (e.g., orifices). The internal restrictions are configured to present a relatively larger resistance to flow through the restrictor tube than the remaining portions of the interior of the restrictor tube itself. The restrictor tubes may generally have cylindrical cross-sections, though other cross-sectional shapes are possible. The restrictor tubes may be disposed within the fluid pathway with the fluid passing through the interior of the restrictor tubes, and the restrictor tubes may generally be aligned with the longitudinal axis of the wellbore tubular within the fluid pathway. The plurality of internal restrictions may then provide the specified resistance to flow.

Other suitable flow restrictions may also be used including, but not limited to, narrow flow tubes, annular passages, bent tube flow restrictions, helical tubes, and the like. Narrow flow tubes may comprise any tube having a ratio of length to diameter of greater than about 2.5 and providing for the desired resistance to flow. Similarly, annular passages comprise narrow flow passages that provide a resistance to flow due to frictional forces imposed by surfaces of the fluid pathway. A bent tube flow restriction comprises a tubular structure that forces fluid to change direction as it enters and flows through the flow restriction. Similarly, a helical tube flow restriction comprises a fluid pathway that forces the fluid to follow a helical flow path as it flows through the flow restriction. The repeated change of momentum of the fluid through the bent tube and/or helical tube flow restrictions increases the resistance to flow and can allow for the use of a larger flow passage that may not clog as easily as the narrow flow passages of the narrow flow tubes and/or annular passages. Each of these different flow restriction types may be used to provide a desired resistance to flow and/or pressure drop for a fluid flow through the flow restriction. Since the resistance to flow may change based on the type of fluid, the type of flow restriction may be selected to provide the desired resistance to flow for one or more type of fluid.

As illustrated in FIGS. 2A and 2B, the electronic actuator assembly 110 may be positioned proximate the fluid pathway 101 such that, in an unactuated position, blocking member 113 may at least partially prevent fluid flow between the flow control device 100 and the wellbore tubular interior 120. In the particular embodiment illustrated in FIGS. 2A and 2B, blocking member 113 comprises a plug; however, those skilled in the art will appreciate that blocking member may comprise any type of member configured to restrict or prevent fluid flow through the fluid pathway, including, but not limited to, mesh, plugs, valves, pistons, sliding sleeves, and the like. In an embodiment, the blocking member may only partially occlude the fluid pathway and there may be holes in the blocking member. The blocking member 113 may be coupled to an electro-mechanical actuator 114 via a retracting member 115. In the particular embodiment illustrated in FIG. 2, the retracting member 115 comprises a rod; however, those skilled in the art will recognize that the retracting member may comprise any type of member configured to couple or connect the blocking member to the electro-mechanical actuator, including a linking member, a screw gear, a translating rod, a rotating rod, or the like. The electro-mechanical actuator 114, via the retracting member 115, may move the blocking member 113 in order to alter the flow through the fluid pathways 103. For example, the electro-mechanical actuator 114 may move the retracting member 115 to displace the blocking member 113 from a first position (shown in FIG. 2A), which prevents fluid flow through the fluid pathway 103, to a second position (shown in FIG. 2B), which allows fluid flow through the fluid pathway 103. In some embodiments, the blocking member 113 may block a plurality of ports, each of which may provide a different flow path through the fluid pathway. For example, the electro-mechanical actuator 114 may move the retracting member 115 to displace the blocking member 113 from blocking a first port, allowing fluid flow through a first flow path. The electro-mechanical actuator 114 may further be configured to move the retracting member 115 to displace the blocking member 113 to a second position, which allows fluid flow through a second port, alone or in combination with the first port. In the particular embodiment illustrated in FIGS. 2A and 2B, the electro-mechanical actuator 114 is coupled to a solenoid (not shown) and may cause the retracting member 115 to move linearly to reposition the blocking member 113. However, the electro-mechanical actuator 114 can also cause the retracting member 115 to move in a different manner besides linearly. For example, in cases wherein the retracting member comprises a screw gear and the blocking member comprises a plug, the electro-mechanical actuator can cause the screw gear to rotate in order to translate the plug.

As illustrated in FIGS. 2A and 2B, a power source 116 may be coupled to the electronic actuator 110 to provide power for actuating the electronic actuator. In an embodiment, the power source 116 may comprise a battery, may be coupled to a power generation device, may be coupled to a power source within the wellbore, may be coupled to a power source outside the wellbore, or any combination thereof. A current source (such as a capacitor) (not shown) could be used in conjunction with one or more batteries in the power supply. In an embodiment, the power source 116 may comprise an electrical coupling with the surface of the wellbore, where power is provided from a power source at the surface of the wellbore. In this embodiment, the casing and/or wellbore tubular string may form a portion of an electrical pathway to the production sleeve assembly. In an embodiment, the power source and/or power generation device may be sufficient to power the electronic actuator, the sensor, or combinations thereof. The power source may be coupled to a single electronic actuator and/or sensor, which may result in a plurality of power sources being coupled to a plurality of electronic actuators. In an embodiment, a power source 116 may be coupled to a plurality of electronic actuators, and in some embodiments, a single power source may be coupled to all of the electronic actuators in a production sleeve assembly and/or the wellbore. The power source and/or power generation device may supply power in the range of from about 0.001 watts to about 10 watts, alternatively, from about 0.5 watts to about 1.0 watt. In some embodiments, the power source and/or power generation device may supply power in the range of from about 0.001 watts to about 1.0 watt, or about 0.002 watts to about 0.5 watts.

The electronic actuator assembly may comprise a sensor 117. In the embodiment of FIG. 2, the sensor 117 comprises a fluid pressure sensor. The pressure sensor 117 may be situated proximate the wellbore tubular, and an opening 118 may be disposed within the wellbore tubular wall in order to provide a pressure differential across the pressure sensor 117. In some embodiments, the pressure sensor 117 can be configured to activate the electronic actuator 110 upon detection of a predetermined fluid pressure value. In some embodiments, the pressurized fluid is sourced uphole and delivered through the wellbore tubular. In some embodiments, the pressurized fluid is sourced within the wellbore. For example, fluid pulse telemetry can be implemented, wherein at least one reserve of fluid (e.g., a produced fluid such as water, oil, and/or gas) (not shown) is located downhole and its fluid entrance into the wellbore tubular is controlled via a valve. Digital commands can be transmitted to the valve to determine opening and closing of the valve. Through the opening and closing of the valve, the fluid within the wellbore tubular interior may possess pressure fluctuations representing pressure signals, which are thereby detected by the pressure sensor.

The pressure sensor 117 can be configured to detect a pressure value that is less than the pressure value required to rupture a burst disk that may be present in the wellbore. In other words, the use of pressure variations may provide for the use of relatively small pressure fluctuations within the wellbore. Thus, the disclosed pressure sensor offers superior operability in complicated completions involving deep water offshore wells, highly deviated wells and extended reach wells, wherein the ability to create a pressure differential may be limited. The pressure sensor 117 may be configured to detect a value (e.g., a pressure value) transmitted as an analog and/or digital transmission.

Various types of sensors other than fluid pressure sensors may also be used. For example, the sensor can comprise a fluid composition sensor, which activates the electronic actuator in response to detection of a particular fluid composition. The fluid composition sensor can activate the electronic actuator to move the blocking member 113 to a first position in response to detecting a first fluid composition, and to move the blocking memberl 13 to a second position in response to detecting a second fluid composition. Alternatively, the fluid sensor comprises a fluid flow sensor. The fluid flow sensor can be configured to activate the electronic actuator to reposition the blocking member 113 in response to detecting a fluid flow across the sensor.

Moreover, the sensor need not be a fluid sensor, and other types of signal detectors can be used in keeping with the principles of this disclosure. For example, the sensor may be a strain sensor, a hydrophone, an antenna, or any other type of signal detector that is capable of receiving a signal. It should be appreciated that the sensor may be replaced by other types of sensors, and the retracting member could be operated in response to, for example, detection of a certain physical property (e.g., pressure, temperature, resistivity, oil/gas ratio, water cut, radioactivity, etc.), passage of a certain period of time, etc.

In other embodiments, the sensor comprises an electric sensor. The electric sensor can comprise a wired or a wireless sensor, and it can sense analog or digital transmissions. In cases involving a wireless sensor, the electric signal can be an electromagnetic signal. The electromagnetic signal can be delivered from a source uphole or from a source within the wellbore, for example, from a transmitting plug disposed within the wellbore. In some embodiments, the wellbore can comprise repeaters for facilitating transmission of wireless signals.

The electronic actuator 110 may comprise a receiving circuit comprising a microprocessor, memory, or the like to respond to the presence of an appropriate signal from the sensor, analyze and interpret the signal, and actuate the electronic actuator 110 in response to a determination that the electronic actuator 110 should be operated. For example, the receiving circuit may be configure to amplify the electrical signal from the receiving antenna, filter the electrical signal from the receiving antenna, determine if the signal is a suitable signal according to one or more rules, trigger the electronic actuator based on a determination that the signal is a suitable signal, and/or any combination thereof, as would be appreciated by one of skill in the art upon viewing this disclosure. In such an embodiment, the receiving circuit may be in signal communication with the receiving antenna. In an embodiment, the receiving circuit may receive an electrical signal from the receiving antenna and generates an output response (e.g., an electrical current or an electrical voltage). In an embodiment, the receiving circuit may comprise any suitable configuration, for example, comprising one or more printed circuit boards, one or more integrated circuits (e.g., an ASIC), a one or more discrete circuit, one or more active devices, one or more passive devices components (e.g., a resistor, an inductor, a capacitor), one or more microprocessors, one or more microcontrollers, one or more wires, an electromechanical interface, a power supply and/or any combination thereof. For example, the receiving circuit may comprise a resistor-inductor-capacitor circuit and may configure the receiving antenna to resonate and/or to respond to a predetermined frequency. As noted above, the receiving circuit may comprise a single, unitary, or non-distributed component capable of performing the function disclosed herein; alternatively, the receiving circuit may comprise a plurality of distributed components capable of performing the functions disclosed herein.

Figure 3A:
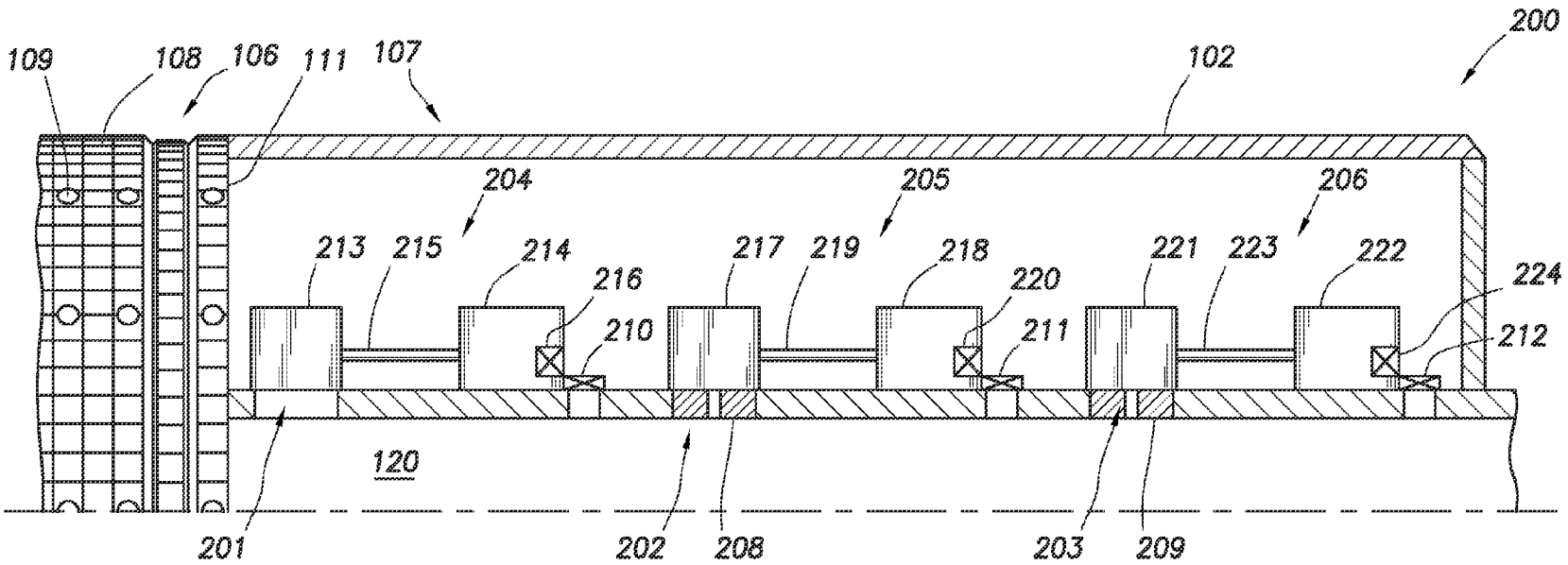
FIGS. 3A-3B are a partial cross-sectional views of another well screen assembly comprising an embodiment of an electronic actuator.
Figure 3B:
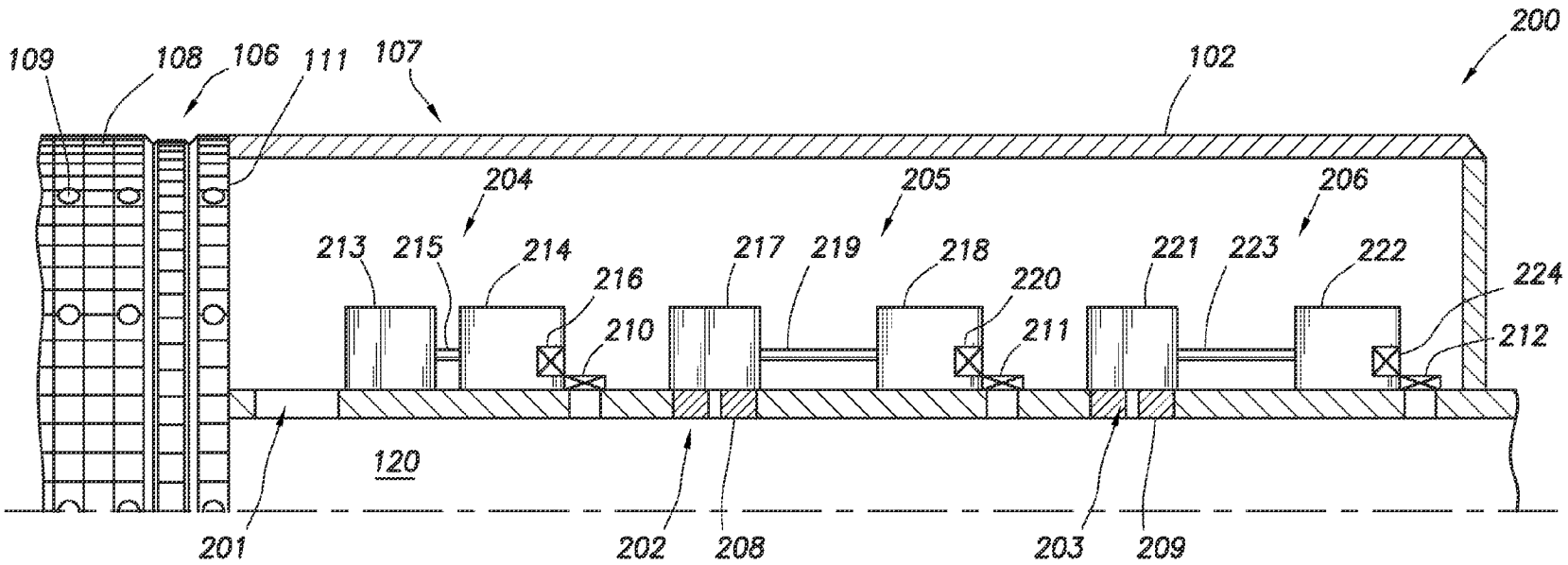

Several embodiments may provide various flow configurations to provide selectable resistance to flow through the production sleeve assembly. Referring to FIGS. 3A and 3B, therein depicted is a production sleeve assembly comprising fluid flow control device 200 comprising a plurality of electronic actuator assemblies 204, 205, 206 associated with a plurality of fluid pathways 201, 202, 203, and each fluid pathway 201, 202, 203 may provide fluid communication between the fluid flow control device 200 and the wellbore tubular interior 120. Each electronic actuator assembly 204, 205, 206 may be associated with at least one sensor 210, 211, 212. In the embodiment depicted in FIGS. 3A and 3B, the first electronic actuator assembly 204 comprises a first blocking member 213, a first retracting member 215, a first electro-mechanical actuator 214, a first power source 216, and a first sensor 210; the second electronic actuator assembly 205 comprises a second blocking member 217, a second retracting member 219, a second electro-mechanical actuator 218, a second power source 220, and a second sensor 211; and the third electronic actuator assembly 206 comprises a third blocking member 221, a third retracting member 223, a third electro-mechanical actuator 222, a third power source 224, and a third sensor 212. In the embodiment of FIGS. 3A and 3B, the sensors 210-212 may comprise fluid pressure sensors for sensing pressure fluctuations, and the signal may comprise a fluid pressure pulse. The first sensor 210 may be configured to activate a first electro-mechanical actuator 214 in response to a first signal to thereby allow fluid flow through a first fluid pathway, the second sensor 211 may be configured to activate a second electronic actuator 205 in response to a second signal and thereby allow fluid flow through a second fluid pathway, and the third sensor 212 may be configured to activate a third electronic actuator 206 in response to a third signal and thereby allow fluid flow through a third fluid pathway. While illustrated as blocking members disposed adjacent fluid pathways, it should be understood that the blocking members may configured to respond to a differential pressure across the blocking members (e.g., by having a differential area to act as a piston) and/or a mechanical biasing force (e.g., a spring force). The differential pressure or force may serve to bias the blocking members and overcome any friction forces present between actuations of the blocking members.

In an embodiment, a plurality of electronic actuators 204, 205, 206 may be configured to actuate based on a single signal. For example, the second and third sensors 211, 212 may be configured to activate the second and third electronic actuators 205, 206 in response to a fourth signal and thereby allow fluid flow through both the second and third fluid pathways 202, 203. The second fluid pathway 202 may comprise a greater resistance to the flow of fluid than the third fluid pathway, due to for example, a more restrictive flow restriction 208, 209. The actuation of the plurality of electronic actuators 204, 205, 206 may be temporally separated, for example by executing in sequence over a time period rather than simultaneously in response to the single signal. In some embodiments, one or more of the plurality of electronic actuators 204, 205, 206 may be configured to have a plurality of actuation conditions based on different signals. For example, a signal may actuate two or more of the plurality of electronic actuators 204, 205, 206, and a separate signal may operate a different plurality of the plurality of electronic actuators 204, 205, 206.

In operation, the wellbore tubular string comprising one or more of the production sleeve assemblies may be disposed in the wellbore with one or more of the fluid pathways closed 201-203. In an embodiment, all of the fluid pathways may be closed to allow various completions and/or installation procedures to be performed without clogging the fluid pathways. For example, a gravel packing procedure may be performed to pack the annulus between the wellbore wall and the wellbore tubular and/or production sleeve assembly with gravel. Various completion procedures such as hydraulic fracturing operations, acid treatments, and the like may be performed to prepare the formation for production.

When the wellbore tubular string has been installed and set in the wellbore, the production sleeve assembly may be reconfigured to a desired state. In some embodiments, the reconfiguration of the production sleeve assembly may be used upon testing and/or conditions within the wellbore. In order to reconfigure the production sleeve assembly, a first signal may be generated and transmitted to a first sensor. Upon the first sensor detecting the first signal, the first electronic actuator 204 may be actuated to cause a first blocking member 213 to translate from a first position (shown in FIG. 3A) to a second position (shown in FIG. 3B). As seen in FIG. 3B, the second position may comprise a refracted position, which may allow fluid flow through the first fluid pathway 201 and provide fluid communication between the exterior of the wellbore tubular and wellbore tubular interior 120. In an embodiment, the first fluid pathway 201 may provide a relatively unrestricted fluid pathway.

When the production sleeve assembly is to be further reconfigured, a second signal may be generated and transmitted to a second sensor 211. Upon the second sensor 211 detecting the second signal, a second electronic actuator assembly 205 may be actuated to open fluid communication through a second fluid pathway 202. Any subsequent fluid pathways such as a third fluid pathway 203, may remain substantially blocked. The second fluid pathway 202 may provide a restricted fluid pathway with a flow restriction 208 provided within the fluid pathway. Alternatively or additionally, a fluid pathway having a lower resistance to fluid flow than the second fluid pathway, but having a higher resistance to fluid flow than the first fluid pathway may be provided by generating a third signal and transmitting the third signal to a third sensor 212. Upon the third sensor 212 detecting the third signal, a third electronic actuator 206 assembly may be actuated to open fluid communication through a third fluid pathway 203. When the third signal is created before or without the second signal, the second fluid pathway 202 may remain closed to fluid communication. An overall fluid pathway may then be provided through the first fluid pathway 201 and the third fluid pathway 203, and the resistance to flow through the overall fluid pathway may be based on the combination of the individual resistances provided in the first fluid pathway 201 and the third fluid pathway 203. Since the first fluid pathway 201 is relatively unrestricted relative to the second fluid pathway 202 and the third fluid pathway 203, the majority of any fluid flow may pass through the first fluid pathway 201.

In still another embodiment, a fourth signal may be generated and transmitted to the production sleeve assembly. The second sensor 211 and the third sensor 212 may be configured to respond to the fourth signal and actuate the second electronic actuator 205 and the third electronic actuator 206, thereby opening the second fluid pathway 202 and the third fluid pathway 203. An overall fluid pathway may then be provided through the second fluid pathway 202 and the third fluid pathway 203, and the resistance to flow through the overall fluid pathway may be based on the combination of the individual resistances provided in the second fluid pathway 202 and the third fluid pathway 203.

As would be apparent to one of ordinary skill in the art with the benefit of this disclosure, the production sleeve assembly can comprise various fluid flow control devices, flow restrictions, and electronic actuator assemblies. Also, the actuation need not involve fluid pressure pulses. For example, the signal may comprise a delivery of pressurized fluid from uphole. In such circumstances, the first sensor can be configured to actuate the first electronic actuator in response to a first pressure value, the second sensor can be configured to actuate the second electronic actuator in response to a second pressure value, and the third sensor can be configured to actuate the third electronic actuator in response to a third pressure value. Alternatively, the signal may comprise another type of signal besides pressure pulse telemetry (e.g., acoustic, tubular string, manipulation, electromagnetic signal, etc.). Also, both the second and third sensors can be configured to activate the second and third electronic actuator in response to a fourth signal. Similarly, all of the sensors may be configured to actuate the corresponding electronic actuators in response to a fifth signal, thereby opening all of the fluid pathways through the production sleeve assembly at once.

In some embodiments, the electronic actuator assemblies can comprise electrical sensors, for example, electromagnetic signal sensors. In such cases, the first sensor can be configured to actuate the first electronic actuator in response to a first electromagnetic signal, a second sensor can be configured to actuate the second electronic actuator in response to a second electromagnetic signal, and the third sensor can be configured to actuate the third electronic actuator in response to a third electromagnetic signal. Also, both the second and the third sensors can be configured to actuate the second and third electronic actuators in response to a fourth telemetric signal, and the first, second, and third sensors can be configured to actuate the first, second, and third electronic actuators in response to a fifth signal.

Over the life of the well, it may become desirable to increase or decrease the flow rate associated with the fluid flow path. In such circumstances, the user may, during production, selectively tailor the flow rate by altering the fluid pathways that are unblocked. For example, in an embodiment, in addition to responding to any of the signals described above, the second sensor can be configured to also respond to a sixth signal. In response to the sixth signal, the second sensor may actuate the second electronic actuator to extend the second retracting member such that second blocking member at least partially prevents fluid flow through the second fluid pathway. The third sensor can be configured to detect a seventh signal, and in response thereto, actuate the third electronic actuator to extend the third retracting member such that the third blocking member at least partially prevents fluid communication through the third fluid pathway. Further, the second sensor and third sensor can be configured to detect an eighth signal. In response to detection of the eighth signal, the second and third electronic actuators can activate the second and third retracting members to extend the second and third blocking members and prevent fluid flow through the second and third fluid pathways. Also, the first sensor can be configured to detect a ninth signal in addition to the first signal, and in response thereto, move the blocking member such that fluid flow through the first fluid pathway is substantially prevented. The ninth signal can be distinct from the second through eighth signals, such that the first blocking member is controlled independently of the other blocking members; or, the ninth signal can be the same as any one of the second through eighth signals. For example, the ninth signal can be the same as the eighth signal. Thus, the user may substantially prevent fluid communication through the portion of the wellbore tubular by transmitting the ninth signal.

One of ordinary skill in the art will appreciate that the system can comprise any number of electronic actuator assemblies and it is not limited to a second and a third. Also, each sensor can be configured to detect any number of signals, and thus various groupings of actuator assemblies within a system can be actuated together. For example, the system can comprise a first electronic actuator assembly comprising a first sensor for detecting a first signal to thereby open a first fluid pathway. After the first fluid pathway has been opened, additional signals can be transmitted to reconfigure the production sleeve assembly. For example, the second signal can open a second fluid pathway and a third fluid pathway; a third signal can open a fourth fluid pathway, a fifth fluid pathway, and a sixth fluid pathway; a fourth signal can open the second, third fourth, fifth and sixth fluid pathways; a fifth signal can open the first, second, and third fluid pathways; and a sixth signal can open the first, third, fourth, and fifth fluid pathways, etc. Therefore, the system provides a multitude of fluid flow path options and enables a user to specifically tailor the flow path in accordance with the well conditions.

Figure 4A:
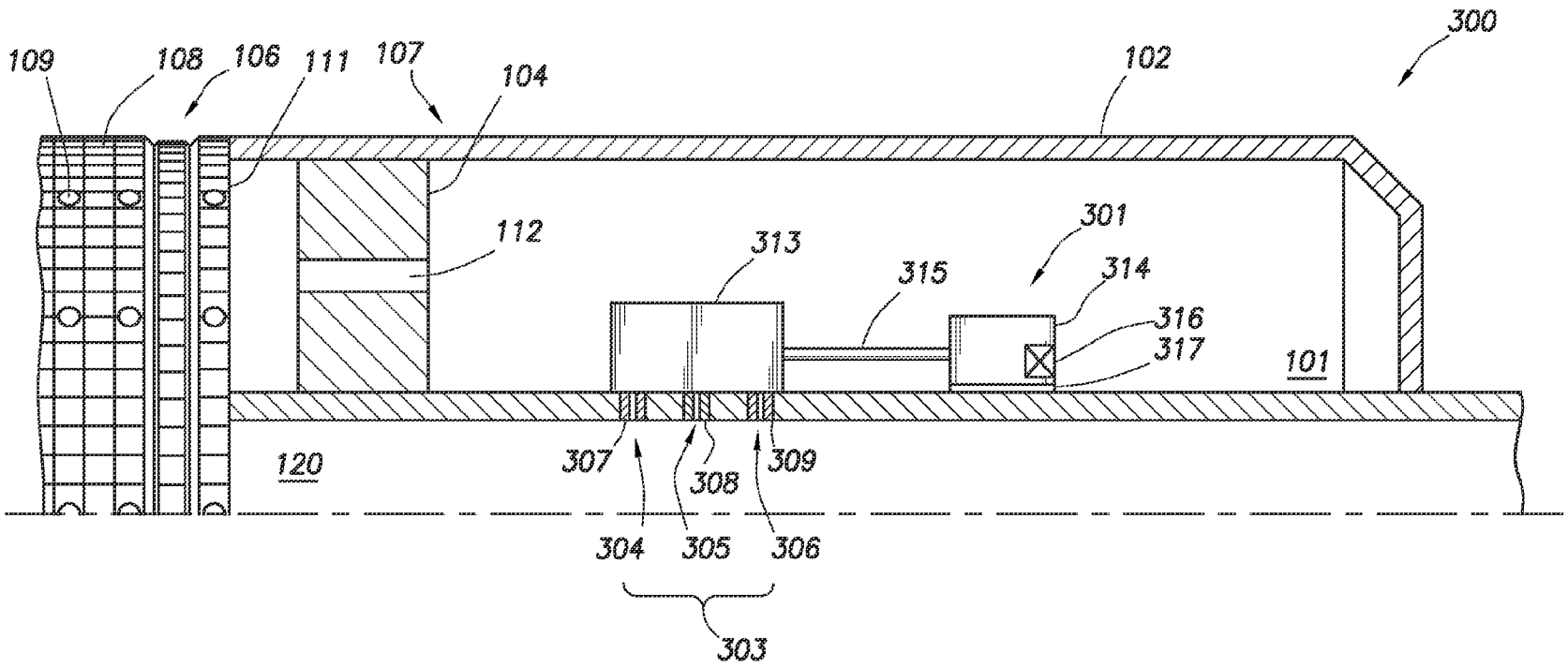
FIGS. 4A-4B are partial cross-sectional views of still another well screen assembly comprising an embodiment of an electronic actuator.
Figure 4B:
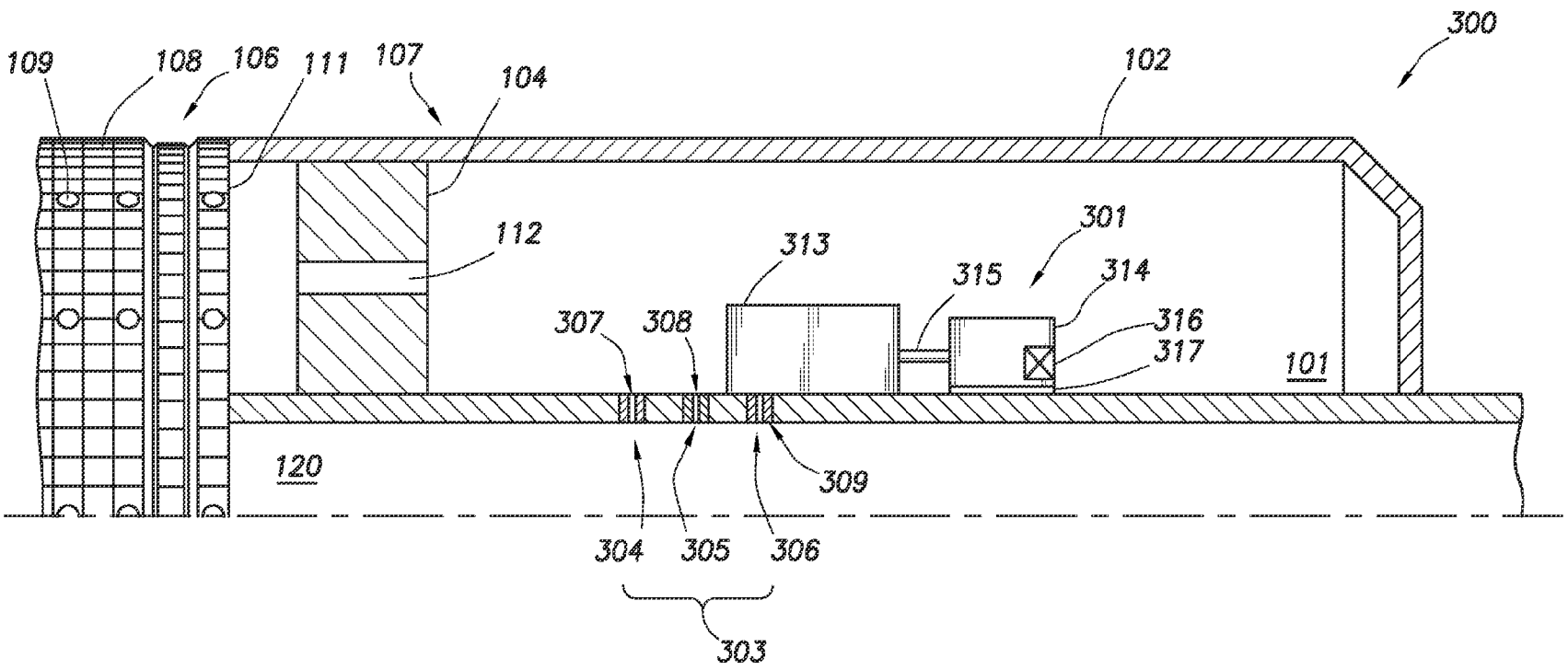

Referring next to FIGS. 4A and 4B, therein depicted is an electronic actuator assembly 301 comprising a blocking member 313, retracting member 315, electro-mechanical actuator 314, power source 316, and sensor 317. The retracting member 315 can move the blocking member 313 to various actuated positions. Like in the other embodiments described herein, the electronic actuator assembly 301 may be installed in the wellbore in its unactuated configuration. In this configuration, the blocking member 313 may be in its unactuated position wherein fluid flow through the fluid pathway may be substantially prevented. Thereafter, the blocking member 313 can be relocated to several actuated positions, each allowing various levels of fluid flow through the fluid pathway 303. A sensor 317 can detect one or more signals and actuate the electronic actuator 301 to relocate the blocking member 313 to a particular actuated position, based on the type of signal that the sensor detects.

In the particular embodiment illustrated in FIGS. 4A and 4B, the sensor 317 is an electric sensor that detects various electromagnetic signals. However, those skilled in the art will appreciate that the sensor need not be an electromagnetic sensor and it could be any type of sensor, including a fluid pressure sensor, a fluid flow sensor, or a fluid composition sensor. Further, the blocking member 313 is illustrated as blocking fluid pathway 303, but it should be understood that the blocking member 313 could also be configured to block the flow restrictor 112 alone or in combination with one or more portions of the fluid pathway 303. Any combination of fluid pathways may be blocked and/or selectively uncovered in accordance with the embodiments disclosed herein.

In operation, a user can transmit a first electromagnetic signal, and upon detection of the first signal by the sensor 317, the electronic actuator 301 may actuate and cause the retracting member 315 to move the blocking member 313 only slightly to a first actuated position, wherein the blocking member 313 unblocks a first port to provide fluid communication along a first fluid pathway 304. The first fluid pathway 304 may comprise a first fluid restriction 307 and thus provide a restricted fluid flow through the first fluid pathway 304. A second signal may then be transmitted, and upon detection of the second signal by the sensor 317, the electronic actuator 301 may actuate and cause the retracting member 315 to move the blocking member 313 to a second actuated position. FIG. 4B illustrates an embodiment of an electronic actuator assembly 301 in a second actuated position. As shown in FIG. 4B, in the second actuated position, the blocking member 313 may unblock a second port to provide fluid communication along a second fluid pathway 305. The second fluid pathway 305 may comprise a flow restriction 308 that is less restrictive fluid flow than the first flow restriction 307 associated with the first fluid pathway 304, thereby reducing the overall resistance to flow through the production sleeve assembly. A third signal may be transmitted, and upon detection of the third signal by the sensor 317, the electronic actuator 301 may actuate and cause the retracting member 315 to move the blocking member 313 to a third actuated position. In the third actuated position, the blocking member 313 may unblock a third port to provide fluid communication along a third fluid pathway 306 as well as the first and second fluid pathways 304, 305. The third fluid pathway 306 may comprise a flow restriction 309 that is less restrictive than both the first flow restriction 307 or the second flow restriction 308, thereby further reducing the overall resistance to flow through the production sleeve assembly.

In order to increase the resistance to flow through the flow control device 300 and/or decrease the flow rate through the fluid pathway 303, a fourth signal may be transmitted to actuate the electronic actuator 301. Upon detection of the fourth signal by the sensor 317, the electronic actuator 301 may actuate and cause the retracting member 315 to move the blocking member 313 back to the second actuated position (as shown in FIG. 4B), thereby closing the third fluid pathway 306. In an embodiment, the fourth signal may be the same as the second signal, such that the selection of the first, second, or third signal indicates the relative actuated position (e.g., the first actuated position, the second actuated position, or the third actuated position, respectively) that the electronic actuator 301 may cause the blocking member 313 to assume. For example, the transmission of the first signal and reception of the first signal by the sensor 317 may cause the electronic actuator 301 to actuate the blocking member 313 to the first actuated position. Thus, during production, the user can selectively tailor the flow rate by altering the particular manner in which the plurality of fluid pathways 304, 305, and 306 are blocked or unblocked.

It will be readily apparent to those skilled in the art that the electronic actuator assembly 301 can comprise virtually any number of actuated positions and that the sensor 317 can detect virtually any number of corresponding signals. Thus, the actuator 301 can be designed to increase the fluid flow through the pathway by virtually any number of incremental values between a fully closed position and a fully open position.

Figure 5:
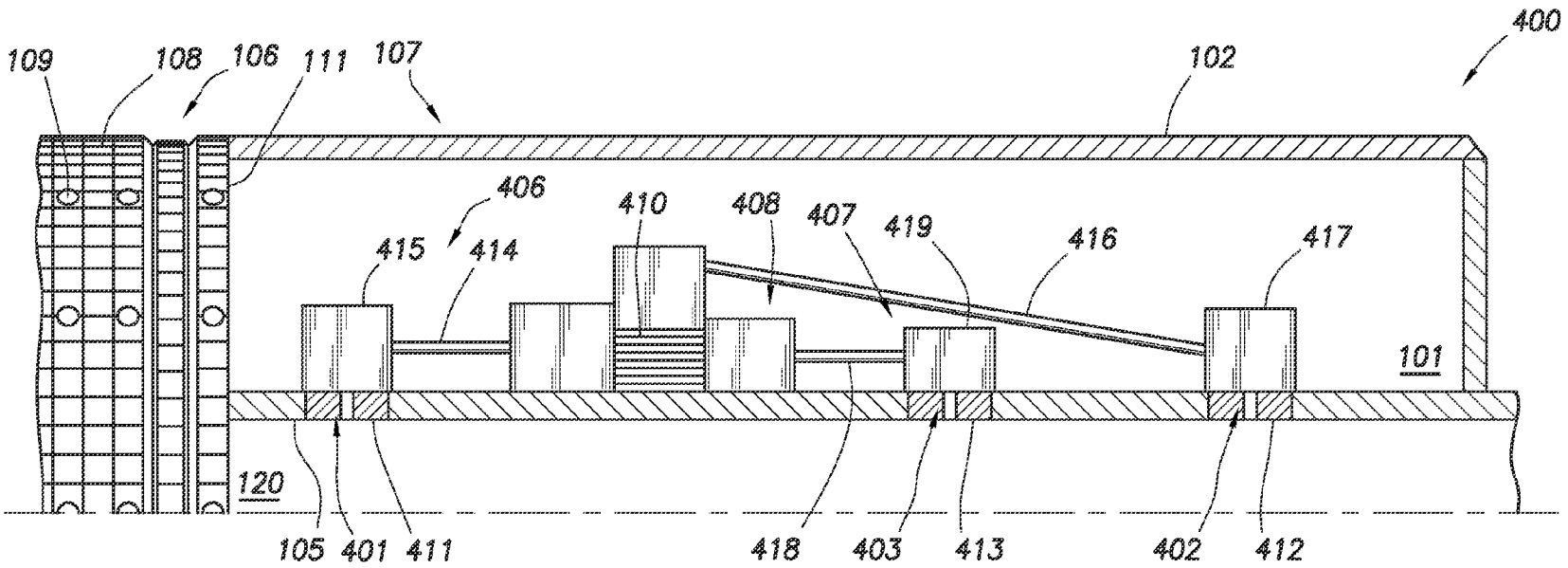
FIG. 5 is a partial cross-sectional view of yet another well screen assembly comprising an embodiment of an electronic actuator.

Referring next to FIG. 5, therein depicted is an embodiment wherein a fluid control device 400 comprises a plurality of fluid pathways 401-403 and an electronic actuator assembly 406-408 associated with each fluid pathway 401-403. One or more of the fluid pathways 401-403 may be also associated with a flow restriction 411-413 for providing a particular resistance therethrough. For example, the first electronic actuator assembly 406 can be associated with a first fluid pathway 401 and a first flow restriction 411, which may provide a first resistance to fluid flow therethrough, a second electronic actuator 407 assembly can be associated with a second fluid pathway 402 and a second flow restriction 412, which may provide a second resistance to fluid flow therethrough, and a third electronic actuator 408 assembly can be associated with a third fluid pathway 403 and a third flow restriction 413, which may provide a third resistance to fluid flow therethrough. The electronic actuator assemblies 406-408 can be communicatively coupled to at least one sensor 410. The at least one sensor 410 can be configured to detect any kind of signals, for example, a fluid pressure signal (e.g., a fluid pulse signal, a sonic signal, etc.) or an electromagnetic signal, and the sensor can be configured to detect a multitude of signals. Each of the actuator assemblies 406-408 may comprise their own sensor, or (as shown in FIG. 5) each of the actuator assemblies 406-408 may all be in communication with one sensor 410. Alternatively, the system may comprise plurality of sensors, and each sensor may be in communication with more than one actuator assembly.

In the particular embodiment depicted in FIG. 5, one sensor 410 is communicatively coupled to all three of the electronic actuator assemblies 406-408. The sensor 410 may comprise a receiving circuit as described herein that is capable of detecting various signals. For example, a first signal may correspond to retracting the first electronic actuator assembly 406; a second signal may correspond to extending the first electronic actuator assembly 406; a third signal may correspond to retracting the second electronic assembly 407; a fourth signal may correspond to extending the second electronic actuator assembly 407; a fifth signal may correspond to retracing the third electronic actuator assembly 408; a sixth signal may correspond to extending the third electronic actuator assembly 408. The multitude of signals can also comprise signals associated with a plurality of electronic actuator assemblies 406-408. For example, a seventh signal may correspond to retracting the first electronic actuator 406 assembly while extending the second electronic actuator assembly 407; an eight signal may correspond to retracting the first and second electronic actuator assemblies 406, 407 while extending the third actuator assembly 408; a ninth signal may correspond to retracting the first and third electronic actuator assemblies 406, 408 while extending the second electronic actuator assembly 407; and so forth for each subset of the electronic actuator assemblies 406-408. Further, the electronic actuator assemblies 406-408 may be configured similar to those described with respect to the embodiment of FIGS. 4A and 4B. For example, in response to a particular signal, the retracting member 414, 416, 418 can move the blocking member 415, 417, 419 to one of various positions such that the blocking member 415, 417, 419 partially blocks the fluid pathway 401-403, substantially blocks the fluid pathway 401-403, or substantially opens the fluid pathway 401-403. Alternatively, in response to a particular signal, the retracting member 414, 416, 418 can move the blocking member 415, 417, 419 to one of various positions such that the blocking member 415, 417, 419 blocks or opens one or more ports to provide fluid communication along one or more corresponding fluid pathways 401-403. Thus any combination of fluid pathways can be selectively opened and/or closed, such that each configuration produces a distinct overall flow path. Therefore, the disclosed system enables the user to selectively tune the flow path.

Figure 6A:
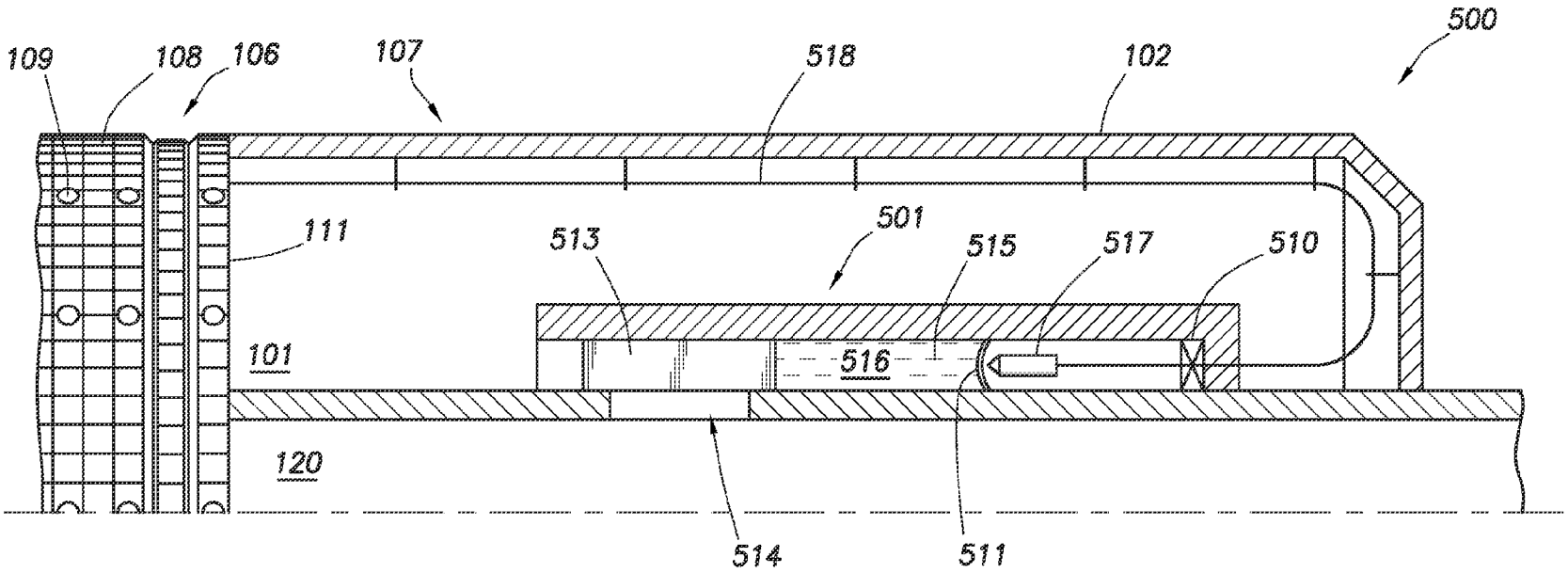
FIGS. 6A-6B are partial cross-sectional views of a well screen assembly comprising an embodiment of an electronic actuator.
Figure 6B:
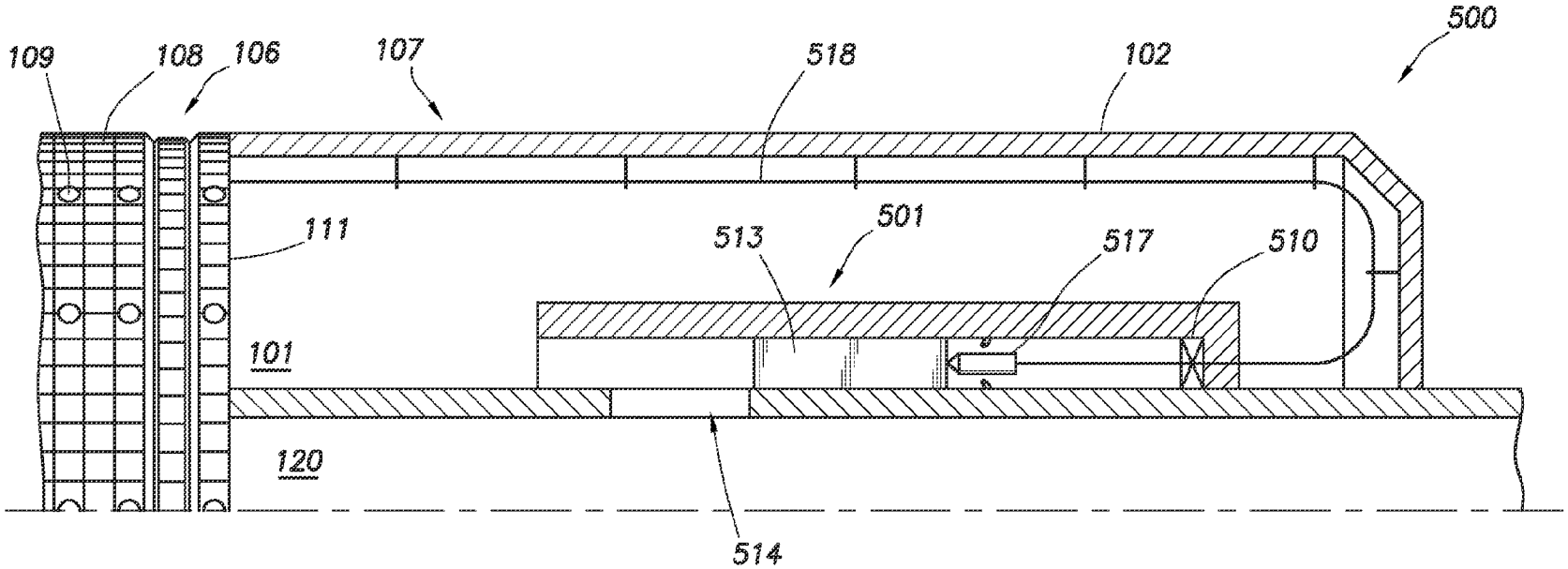

Referring to FIGS. 6A-6B, an embodiment of a fluid flow device comprising another embodiment of an electronic actuator assembly 501 is schematically illustrated. The fluid flow control device 500 may comprise a sensor 510 and an electronic actuator 501 and may be suitably coupled to other similar fluid flow control devices, seal assemblies, production tubulars or other downhole tools to form a tubing string as described above. In an embodiment, the electronic actuator 501 comprises an electronic rupture device 517 and an actuable device 511. The actuable device 511 may comprise any device configured to provide fluid communication therethrough in response to being punctured by the rupture device such as a rupture disk, a membrane, a shear pin, and the like.

FIGS. 6A and 6B illustrate a piston 513 slidably and sealingly disposed within fluid pathway that initially blocks fluid communication along the fluid pathway 514 through the fluid port. The piston 513 can be biased towards the actuable device 511 by pressure acting on a differential piston area. Alternatively, a biasing device such as a spring may engage and act on the piston to bias the piston towards the actuable device 511. Initially, displacement of piston 513 towards the actuable device 511 is substantially prevented by a fluid 515 disposed within a fluid chamber 516 formed between the actuable device 511 and the piston 513. The fluid 515 may be a substantially incompressible fluid such as a hydraulic fluid but could alternatively be a compressible fluid such as nitrogen, a combination of substantially incompressible fluids, a combination of compressible fluids or a combination of one or more compressible fluids with one or more substantially incompressible fluids. While the fluid 515 prevents the piston 513 from moving sufficiently to open communication through the fluid pathway 514, the piston 513 is able to float as pressure differences between the pressure in the fluid pathway 101 and fluid chamber 516 are balanced.

The actuable member 511 may initially prevent and/or restrict fluid from escaping from the chamber 516. As shown in FIGS. 6A and 6B, the actuable member 511 is depicted as a disk member and may be formed from a metal but could alternatively be made from a plastic, a composite, a glass, a ceramic, a mixture of these materials, or other material suitable for initially containing the fluid 515 in the chamber 516 while being configured to fail in response to an being ruptured by the rupture device.

The rupture device 517 may comprise any device configured to actuate the actuable device and create fluid communication therethrough. In an embodiment, the rupture device may comprise a chemical jet nozzle assembly. The chemical jet nozzle assembly may include a chemical element or energetic material, an ignition agent and a nozzle. The chemical element may be formed from any suitable component configured to generate an exothermic chemical reaction, for example, a thermite reaction. The ignition agent may be connected to the receiving circuit via an electrical coupling so that, when it is determined that electronic actuator should be operated, the receiving circuit can supply electrical current to an ignition agent.

Upon initiation of the ignition agent, the chemical element may be initiated, and the nozzle may focus the heat and molten materials created in the exothermic reaction into a hot jet that is directed towards actuable device. The hot jet causes a focused hot spot on actuable device resulting in the desired actuation of actuable device. It is noted that the mode of actuation of actuable device may including penetrating, melting, combustion, ignition, weakening or other degradation of barrier. Fluid communication is thus established between a chamber and a lower pressure chamber adjacent the rupture device 517 through the opening formed in the actuable device. The opening may allow the fluid 515 to exit the chamber as the piston is urged towards the now ruptured actuable device 511 by pressure from the fluid pathway acting on differential piston area. Alternatively, a biasing device may drive the piston 513 towards the rupture device 517. The configuration of the electronic actuator may then be as seen in FIG. 6B. When the piston translates past the port, fluid communication may be permitted along the fluid pathway through the port.

Various other designs are also possible for the electronic actuator 501 comprising a rupture device 517 and an actuable device 511. Suitable electronic actuators may include any of those described in U.S. Patent Publication No. 2010/0175867 to Wright, et al. entitled "Well Tools Incorporating Valves Operable by Low Electrical Power Input," U.S. Patent Publication No. 2011/0174504 to Wright, et al. entitled "Well Tools Operable Via Thermal Expansion Resulting from Reactive Materials," and U.S. Patent Publication No. 2011/0265987 to Wright, et al. entitled "Downhole Actuator Apparatus Having a Chemically Activated Trigger," each of which is incorporated herein by reference in its entirety.

The sensor 510 may comprise any of those sensors and/or sensor types described herein. In an embodiment, the sensor comprises a plurality of are electric sensors. The electric sensor may be coupled to a wireless power source, such as a battery. In addition or as an alternative to the wireless power source, the electric sensor may be hard-wired to a power source, such as a generator and/or a power source at the surface of the wellbore.

The electric sensor 510 may be configured to sense a wireless electromagnetic signal and/or may be configured to sense an electromagnetic signal from a signal source via an electric line. The electromagnetic signal source may be located uphole or downhole. In some embodiments (including the embodiment shown in FIG. 6) the electric sensor 510 may receive an electric signal via the electric line 518 that couples the electric sensor 510 to a wireless link (not shown), and the wireless link may receive wireless signals from a source uphole. The wireless link may be wired to a plurality of electric sensors via one or more electrical lines 518, thereby allowing a user to control numerous electronic actuator assemblies through communication with a single wireless link. In some embodiments, the electric sensor 510 is hard-wired to both the power source and the signal source. In such cases, the sensor's connection to the power source may use a same or a different electric line as the sensor's connection to the signal source. In the particular embodiment shown in FIG. 6, the sensors 510 are electrically coupled to both the power source and the wireless link via a single electric line 518.

Electronic sensor 510 can comprise a receiving circuit as described herein that is capable of detecting various signals. In an embodiment, the sensor 510 may comprise an electric card comprising a wireless sensor, and the wireless signal may be an electromagnetic signal and/or a sonic signal. The electric card can be electrically coupled to a plurality of electronic actuators. The electric card can be programmed to detect a multitude of signals, and the multitude of signals can comprise signals associated with every subset of electronic actuators. For example, a first signal may correspond to a first electronic actuator, a second signal may correspond to a second electronic actuator assembly, a third signal may correspond to a third electronic actuator assembly, a fourth signal may correspond to a fourth electronic actuator assembly, a fifth signal may correspond to the first electronic actuator assembly and the second electronic actuator assembly, a sixth signal may correspond to the first electronic actuator assembly and the third electronic actuator assembly, and so on, for each subset. Thus, by selecting the particular signal transmitted to the sensor, the actuation of the electronic actuator or plurality of electronic actuators can be selectively controlled.

While FIG. 6A and FIG. 6B illustrate a fluid pathway through the production sleeve assembly, it should be understood that various other components may be incorproated into the production sleeve assembly in keeping with the principles of the present disclosures. In an embodiments, a flow restriction may be disposed in series or parallel with the fluid pathway 514. For example, a flow restriction may be disposed in parallel with the fluid pathway 514, and fluid flow may initially proceed through the production sleeve assembly through a flow restriction. A port in the wellbore tubular may provide a restricted flow through the production sleeve assembly. The fluid pathway 514 may then be configured to provide a bypass route having a lower resistance to fluid flow as compared to the fluid pathway through the flow restriction. Additional arrangements of the components as described herein are possible in keeping with the embodiments disclosed herein.

In operation, the production sleeve assembly can be installed in a wellbore in its unactuated configuration (shown in FIG. 6A). In the unactuated configuration, fluid flow from the exterior of the wellbore tubular to the wellbore tubular interior 120 may be substantially prevented by way of piston 513. In order to initiate production flow, at least one electronic actuator 501 may be actuated to thereby provide fluid flow through at least one fluid pathway 514 between the exterior of the wellbore tubular to the wellbore tubular interior 120.

The production sleeve assembly may be reconfigured by initiating the transmission of a signal. Upon transmission, the signal can travel to the sensor 510 located within the wellbore. One or more intermediate receivers and/or transmitters (e.g., repeaters) may be present between the original transmission source and the sensor associated with a specific electronic actuator. When the signal is received by the sensor, the sensor may detect the signal, and a receiving circuit associated with the sensor and/or electronic actuator can determine whether the first signal corresponds to a signal for actuating one or more electronic actuators. Upon the receiving circuit determining that the first signal comprises a suitable signal (e.g., pattern or particular type of signal amplitude, phase, slope, profile, etc.) for actuating the electronic actuator, an initiator may be ignited to cause the rupture device to puncture an actuable device. In response thereto, the punctured actuable device containing an aperture therethrough may allow fluid flow through a corresponding fluid pathway. In some embodiments, the punctured actuable device may result in the movement of a piston or other blocking member located in the fluid pathway, thereby allowing fluid flow through the fluid pathway.

The production sleeve assembly can be further reconfigured through the transmission of a second signal that corresponds to the opening and/or closing of a particular fluid pathway. Upon transmission, the signal may travel through the wellbore to the sensor. When the signal reaches the sensor, the sensor can detect the second signal, and the receiving circuit can determine if the signal is a suitable signal. Upon the receiving circuit determining that the second signal comprises a suitable signal for actuating a second electronic actuator, an initiator may be ignited to cause the rupture device to puncture an actuable device. In response thereto, the punctured actuable device containing an aperture therethrough may allow fluid flow through a corresponding fluid pathway. In some embodiments, the punctured actuable device may result in the movement of a piston or other blocking member located in the fluid pathway, thereby allowing fluid flow through the fluid pathway.

The signal may comprise a single signal that represents the opening of all the fluid pathways that are to be opened. Alternatively, the signal may comprise more than one signal, wherein each signal represents the opening of one or some of the fluid pathways which are to be opened. In an embodiment, suitable signals may be transmitted throughout the life of the wellbore to reconfigure one or more fluid pathways through the production sleeve assembly.

In an embodiment, a plurality of production sleeve assemblies may be disposed along the length of the wellbore. One or more of the production sleeve assemblies may be disposed in multiple zones along the wellbore, thereby forming a completion assembly for the production of fluid into the wellbore tubular interior. When a plurality of production sleeve assemblies are present, some, or all of, the production sleeve assemblies may comprise the electronic actuator assembly 501 and sensors as described herein. Further, the specific configuration of the electronic actuator assemblies 501 and sensors 510 in each of the production sleeve assemblies comprising these parts, may be the same or different. For example, a first production sleeve assembly may comprise an electronic actuator assembly 501 comprising a electro-mechanical actuator while a second production sleeve assembly may comprise an electronic actuator assembly 501 comprising a rupture device. Similarly, for any particular production sleeve assembly comprising a plurality of electronic actuator assemblies, each of the electronic actuator assemblies may be the same, or they may be different.

When one or more of the production sleeve assemblies described herein are present in the wellbore, a signal may be used to actuate only a single electronic actuator assembly 501. For example, a transmitter may transmit a signal that activates a specific electronic actuator assembly 501 in a first production sleeve assembly. In order to actuate another electronic actuator assembly 501, a second signal may be transmitted to actuate one or more of the remaining electronic actuator assemblies in either the same production sleeve assembly or a different production sleeve assembly. This process may be repeated to actuate the desired number of electronic actuator assemblies 501 in the wellbore, and thereby configure the desired number of fluid pathways within the wellbore. In an embodiment, a single signal transmitted by the transmitter may actuate a plurality of electronic actuator assemblies 501, which may be in the same or different production sleeve assemblies. For example, two or more of the electronic actuator assemblies 501 on different production sleeves may be configured to actuate based on the same signal. In this embodiment, a transmitter may be used to actuate the applicable plurality of electronic actuator assemblies 501 in a single transmission. For example, two or more of the production sleeve assemblies may be transitioned from an initially closed run in configuration to an open configuration. Other reconfigurations as described herein may also be possible.

In an embodiment, a transmitter may transmit a plurality of signals at the same time, which may actuate a plurality of electronic actuators, which may or may not be in the same production sleeve assembly. For example, the transmitter may transmit a plurality of signals, with each signal being configured to actuate one or more of the electronic actuators. The use of a single transmission comprising a plurality of signals may allow for a relatively fast reconfiguration of the completion assembly comprising a plurality of production sleeve assemblies.

While the production sleeve assembly and methods described with respect to FIGS. 2-6 are generally described in terms of transitioning the various fluid pathways from a closed configuration to a restricted configuration, and further to an open configuration, the production sleeve assembly may be transitioned between any number of configurations. For example, the fluid pathways through the production sleeve assembly may be transitioned from an open position to a restricted position to a closed position. Alternatively, the production sleeve assembly may be transitioned from a restricted position to a closed position to an open position. In an embodiment, any combination of these configurations is possible. Further, the use of a plurality of electronic actuator assemblies may allow for more or less than three configurations. For example, the production sleeve assembly may be transitioned from a closed position to an open position using the electronic actuator, sensor(s), driving members, blocking members, and/or rupture devices described herein. In an embodiment, the production sleeve assembly could be transitioned between four or more fluid pathway configurations.

Further, when a plurality of production sleeve assemblies are disposed along the wellbore tubular string, each production sleeve assembly may have the same number of transitions and configurations or a different number of transitions and configurations. For example, a first production sleeve assembly may have three separate fluid pathway configurations (e.g., closed, restricted, open) while a second production sleeve assembly may have four or more separate fluid pathway configurations. The ability to provide different configurations and transitions may allow a wellbore tubular string comprising one or more production sleeve assemblies to be reconfigured as desired during production, with some zones having more potential configurations than others.

Having described the systems and methods herein, various embodiments may include, but are not limited to:

In a first embodiment, a downhole component comprises a wellbore tubular, a plurality of fluid pathways configured to provide fluid communication within the downhole component, a plurality of electronic actuators configured to selectively provide fluid communication through one or more of the plurality of fluid pathways, and at least one sensor coupled to the plurality of electronic actuators. At least one of the plurality of electronic actuators comprises a blocking member coupled to an electro-mechanical actuator, and one or more of the plurality of electronic actuators are configured to selectively actuate to allow or prevent fluid flow through a corresponding fluid pathway of the plurality of fluid pathways in response to the at least one sensor receiving a suitable signal.

A second embodiment may include the downhole component of the first embodiment, wherein the plurality of fluid pathways are configured to provide fluid communication between an exterior of the wellbore tubular and the interior of the wellbore tubular.

A third embodiment may include the downhole component of the first or second embodiments, further comprising a power source coupled to one or more of the plurality of electronic actuators, wherein the power source is configured to provide the power to actuate the one or more of the plurality of electronic actuators.

A fourth embodiment may include the downhole component of the third embodiment, wherein the power source comprises at least one of a battery, a downhole generator, a surface power source, or a downhole power source.

A fifth embodiment may include the downhole component of the third embodiment, wherein the power source is located at the surface of the wellbore.

A sixth embodiment may include the downhole component of any of the first to fifth embodiments, further comprising a sand control screen section disposed in series with the plurality of fluid pathways.

A seventh embodiment may include the downhole component of any of the first to sixth embodiments, further comprising one or more flow restrictions, wherein the one or more flow restrictions are disposed in at least one of the plurality of fluid pathways.

An eighth embodiment may include the downhole component of any of the first to seventh embodiments, wherein the blocking member is configured to selectively provide the fluid communication through two or more of the plurality of fluid pathways.

A ninth embodiment may include the downhole component of any of the first to eighth embodiments, wherein two or more of the plurality of electronic actuators are configured to selectively actuate in response to the at least one sensor receiving the suitable signal.

A tenth embodiment may include the downhole component of any of the first to ninth embodiments, wherein the at least one sensor comprises a pressure sensor.

An eleventh embodiment may include the downhole component of the tenth embodiment, wherein the suitable signal comprises at least one of a pressure, a pressure wave, one or more pressure pulses, or a sonic signal.

A twelfth embodiment may include the downhole component of any of the first to eleventh embodiments, wherein the one or more of the plurality of electronic actuators are further configured to selectively actuate to transition the plurality of fluid pathways from a first configuration to a second configuration in response to the at least one sensor receiving a suitable signal, wherein in the first configuration all of the plurality of fluid pathways are substantially closed to fluid flow, and wherein in the second configuration one or more of the fluid pathways are open to flow.

In an thirteenth embodiment, a production sleeve assembly for use in a wellbore, the production sleeve assembly comprises a wellbore tubular, a plurality of fluid pathways configured to provide fluid communication between an exterior of the wellbore tubular and the interior of the wellbore tubular, a plurality of electronic actuators, and at least one sensor coupled to the plurality of electronic actuators. At least one of the plurality of electronic actuators comprises a rupture devices disposed adjacent an actuable devices, and the plurality of electronic actuators is configured to selectively provide fluid communication through one or more of the plurality of fluid pathways. The rupture device is configured to actuate the actuable device to allow fluid flow through at least one fluid pathway of the plurality of fluid pathways in response to the at least one sensor receiving a suitable signal.

A fourteenth embodiment may include the production sleeve assembly of the thirteenth embodiment, wherein the rupture device comprises a chemical initiator that is configured to ignite based on the at least one sensor receiving a suitable signal.

A fifteenth embodiment may include the production sleeve assembly of the thirteenth or fourteenth embodiments, wherein the actuable device is configured to provide fluid communication therethrough in response to be being actuated.

A sixteenth embodiment may include the downhole component of any of the thirteenth to fifteenth embodiments, wherein the actuable device is disposed in a first fluid pathway of the plurality of fluid pathways, and wherein the actuable device is configured to provide fluid communication through the first fluid pathway upon being actuated.

A seventeenth embodiment may include the downhole component of any of the thirteenth to sixteenth embodiments, wherein the first fluid pathway comprises a flow restriction.

An eighteenth embodiment may include the downhole component of any of the thirteenth to seventeenth embodiments, further comprising a piston disposed in a fluid pathway of the plurality of fluid pathways, wherein the piston is configured to shift in response to providing fluid communication through the actuable device, and wherein the piston is configured to provide fluid communication through the fluid pathway in response to the shifting.

In a nineteenth embodiment, a method of configuring a production sleeve assembly within a wellbore comprises receiving a signal at a sensor, determining that the signal is a suitable signal, receiving, by one or more electronic actuators of a plurality of electronic actuators, power from a power source, actuating the one or more electronic actuators in response to the determination that the signal is the suitable signal, and selectively opening one or more fluid pathways of a plurality of fluid pathways in response to the actuating of the electronic actuator.

A twentieth embodiment may include the method of the nineteenth embodiment, wherein the one or more fluid pathways provide fluid communication between an exterior of a wellbore tubular and an interior of the wellbore tubular A twenty first embodiment may include the method of the nineteenth or twentieth embodiments, further comprising selectively closing one or more fluid pathways in response to the actuating of the electronic actuator.

A twenty second embodiment may include the downhole component of any of the nineteenth to twenty first embodiments, wherein the power source is located at the surface of the wellbore.

A twenty third embodiment may include the downhole component of any of the nineteenth to twenty second embodiments, wherein the signal comprises at least one of a pressure, a pressure wave, one or more pressure pulses, or a sonic signal.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed:

1. A downhole component comprising: a wellbore tubular disposed within a formation; a filter media associated with the wellbore tubular, wherein the filter media comprises a protective outer shroud, wherein the protective outer shroud comprises a plurality of perforations; a plurality of fluid pathways configured to provide fluid communication within the downhole component; a plurality of restrictor tubes disposed within the plurality of fluid pathways, wherein the each of the plurality of restrictor tubes is aligned with a longitudinal axis of the wellbore tubular within each respective plurality of fluid pathways; a plurality of electronic actuators configured to selectively provide fluid communication through one or more of the plurality of fluid pathways, wherein at least one of the plurality of electronic actuators comprises a blocking member coupled to an electro-mechanical actuator via a retracting member, wherein the blocking member obstructs fluid flow of at least one of the one or more of the plurality of fluid pathways, wherein the at least one of the one or more of the plurality of fluid pathways comprises a fluid pathway between the formation and an interior of the wellbore tubular when in a first actuated configuration; and at least one sensor coupled to the plurality of electronic actuators, wherein one or more of the plurality of electronic actuators are configured to selectively actuate to allow or prevent fluid flow through a corresponding fluid pathway of the plurality of fluid pathways in response to the at least one sensor receiving a suitable signal, wherein the at least one sensor comprises a pressure sensor, and wherein the suitable signal comprises at least one of a pressure, a pressure wave, one or more pressure pulses, or a sonic signal.

2. The downhole component of claim 1, wherein the plurality of fluid pathways are configured to provide fluid communication between an exterior of the wellbore tubular and the interior of the wellbore tubular.

3. The downhole component of claim 1, further comprising a power source coupled to one or more of the plurality of electronic actuators, wherein the power source is configured to provide the power to actuate the one or more of the plurality of electronic actuators.

4. The downhole component of claim 3, wherein the power source comprises at least one of a battery, a downhole generator, a surface power source, or a downhole power source.

5. The downhole component of claim 3, wherein the power source is located at the surface of the wellbore.

6. The downhole component of claim 1, further comprising a sand control screen section disposed in series with the plurality of fluid pathways.

7. The downhole component of claim 1, further comprising one or more flow restrictions, wherein the one or more flow restrictions are disposed in at least one of the plurality of fluid pathways.

8. The downhole component of claim 1, wherein the blocking member is configured to selectively provide the fluid communication through two or more of the plurality of fluid pathways.

9. The downhole component of claim 1, wherein two or more of the plurality of electronic actuators are configured to selectively actuate in response to the at least one sensor receiving the suitable signal.

10. The downhole component of claim 1, wherein the one or more of the plurality of electronic actuators are further configured to selectively actuate to transition the plurality of fluid pathways from a first configuration to a second configuration in response to the at least one sensor receiving a suitable signal, wherein in the first configuration all of the plurality of fluid pathways are substantially closed to fluid flow, and wherein in the second configuration one or more of the fluid pathways are open to flow.

* * * * *